US008146381B2

(12) United States Patent
Roman

(10) Patent No.: US 8,146,381 B2
(45) Date of Patent: Apr. 3, 2012

(54) DRY ICE BOX OR INFUSER BOX WITH RETAINER SYSTEM FOR INTEGRATION WITH STANDARD DRINKING GLASSES

(76) Inventor: Jonathan Roman, San Francisco, CA (US)

( * ) Notice: Subject to any disclaimer, the term of this patent is extended or adjusted under 35 U.S.C. 154(b) by 884 days.

(21) Appl. No.: 12/187,571

(22) Filed: Aug. 7, 2008

(65) Prior Publication Data

US 2010/0031678 A1 Feb. 11, 2010

(51) Int. Cl.
*F24H 3/02* (2006.01)
*H01L 23/467* (2006.01)

(52) U.S. Cl. ..... 62/384; 62/457.2; 62/457.3

(58) Field of Classification Search ..... 62/384, 62/457.2, 457.3, 386; 220/839, 837, 836, 220/810, 711, 703, 324, 315, 359.1; 215/245, 215/237, 235, 387, 232
See application file for complete search history.

(56) References Cited

U.S. PATENT DOCUMENTS 2,447,716 A * 8/1948 Rowe ..... 62/56
2,748,946 A * 6/1956 Smith ..... 210/244
3,666,110 A * 5/1972 Hodges ..... 210/469
4,492,323 A * 1/1985 Essen ..... 222/465.1
4,775,074 A * 10/1988 Ershig ..... 220/323
4,938,375 A * 7/1990 Fantacone ..... 220/709
5,913,964 A * 6/1999 Melton ..... 99/322
6,227,004 B1 * 5/2001 Gerstein ..... 62/421
6,817,951 B2 * 11/2004 Levine ..... 472/57
7,269,969 B2 * 9/2007 Strickland et al. ..... 62/400
7,272,950 B1 9/2007 Roman
7,736,710 B2 * 6/2010 Sandberg ..... 428/34.1
2003/0089725 A1 * 5/2003 Kang ..... 220/703

* cited by examiner

*Primary Examiner* — Cheryl J Tyler
*Assistant Examiner* — Melanie Reuter
(74) *Attorney, Agent, or Firm* — Steven A. Nielsen; Allman & Nielsen, P.C.

(57) ABSTRACT

A system for providing an infusion chamber provides a clip assembly for attachment within a drinking vessel. A box assembly contains an infusion chamber and may be attached to the clip assembly. The box assembly has a top swinging lid to accept dry ice and other materials suitable for infusion. The bottom of the box assembly features a communication void or slot at the bottom of the box to allow the contents of the box assembly to mix with the surrounding drink, but yet not fall loose into the drink. The clip features contoured adhesive wedges to assist in attachment of the clip to the inside portions of a drinking container. The clip assembly has a thin stop tab or shelf that fits into the box assembly. A side hook from the box assembly is supported by the lower portion of the stop tab or shelf of the clip assembly. The upper or top side of the stop tab or shelf is trapped by a stop tab of the box assembly. The use of dry ice within the box assembly and use of liquid such as punch in the drinking vessel, may result vapor from the dry ice to rise though the drink and out of the drink, to create a witches brew effect while cooling and mixing but not diluting the drink as typical with ice made from water.

5 Claims, 14 Drawing Sheets

DRY ICE BOX OR INFUSER BOX WITH RETAINER SYSTEM FOR INTEGRATION WITH STANDARD DRINKING GLASSES

BACKGROUND OF THE INVENTION (1) Field of the Invention

The invention generally relates to means and methods of containing dry ice within a beverage container. More particularly, the invention relates to a dry ice container box or infuser box using a retaining clip to provide an interface between the box and beverage container.

(2) Description of the Related Art

Several methods of using dry ice within a beverage container are known in the related art. The current zenith in the art was disclosed on Sep. 25, 2007 in U.S. Pat. No. 7,272,950 by Roman (the '950 patent) wherein a fixed section is attached to a drinking glass and a movable section acts as a permeable cap to retain dry ice. While innovative and novel, the '950 patent does not contemplate a sealant failure wherein the fixed portion may break free and allow the dry ice to escape into the glass. Thus, what is needed in the art are means and methods of securing a portion of dry ice within a drinking container, such that an attachment failure will not lead to an escape of dry ice or other contained material.

BRIEF SUMMARY OF THE INVENTION

The present invention overcomes shortfalls in the related art by presenting unique and novel methods and devices to redundantly secure dry ice or other material within a drinking container. The present invention provides unexpected results and utility by using a self enclosing box container with means of attachment to a clip, the clip being attached to a standard or customized drinking container or drinking glass. The disclosed clip or clip assembly is comprised of form fitting components to assist in the snug fit of the clip within the drinking container. The use of non toxic adhesives may be used to assist in the attachment of the clip to the inside surfaces of the drinking container. The box assembly uses a living hinge or other means to safely and conveniently secure dry ice or other contents. The disclosed box assembly includes a vent design suitable for allowing the retained dry ice (or other item for infusing) to communicate with the outer consumable liquid. But yet, the box design prevents the solid contents of the box from directly entering the mouth of the user.

The present invention overcomes shortfalls in the '950 patent by providing insulation between the dry ice and the drink. The '950 patent immediately exposes all contained dry ice to the drink, thus cooling the glass and shortening the time of fog generation. The present invention provides a box that holds and insulates the dry ice or other infusing material. The clip assembly minimizes the path of direct contact of dry ice to the glass, providing unexpected results by greatly prolonging the generation of the desired fog or witches brew effect.

The present invention overcomes short falls in the art by providing a two piece interlocking system that allows for one type of material, in the form of a clip assembly, to be affixed or glued to the drinking vessel or drinking glass while a different type of material, in the form of a box assembly, may be used to secure the dry ice or other infusing material. For a box assembly or container to hold the dry ice, it is desirable to have a living hinge to access the box compartment. But, the type of material ideal for construction of a living hinge is not well suited for gluing or otherwise attaching to the inside of a drinking container. Moreover, materials suited for attachment to glass have properties that are not conducive to construction of a box assembly. The disclosed invention provides unexpected results by allowing for the use of the best materials for flexibility in a box assembly and by simultaneously allowing for the best materials to be used for attachment to a drinking vessel. The invention also allows for the clip assemble to be molded into a drinking glass while the box assembly may be inserted by the consumer.

The disclosed assembly may interlock with the disclosed box assembly to allow for the clip assembly to be permanently attached to a drinking vessel and for the box assembly to be removed, replaced, cleaned and otherwise maintained.

One aspect of the invention includes the use of dry ice or solidified $CO_2$ to be introduced within a consumable beverage. Solidified $CO_2$ starts in the form of a cold solid, and when exposed to typical ambient room temperature, sublimates directly into a vapor or gas state, bypassing the liquid state, unlike frozen water. Hence, solidified $CO_2$ is commonly referred to as "dry ice" as no liquid is formed by $CO_2$ at any household temperature. When solidified $CO_2$ reaches room temperature, a visible fog, is created. Solidified $CO_2$ may be inserted within a consumable liquid, such as punch, wherein the warming of the $CO_2$ results in a fog mysteriously rising out of the punch and into the ambient air. This effect is sometimes referred to as "witches brew". In the Halloween season and on other occasions there is a commercial demand for means of creating witches brew.

Solidified $CO_2$ is typically sold in large blocks or in pellet form. For individual beverages, the use of solidified $CO_2$ in pellet from is common. While solidified $CO_2$ is not toxic, the unanticipated consumption of any pellet or solid object within a beverage may lead to choking and is very undesirable. The present invention overcomes a shortfall in the art by providing a self closing box or infusion box that remains closed even in the event of detachment from the user's glass or drinking container.

In addition, the sublimation creates bubbles which causes a mixing action which obviates the need for stirring or shaking a drink to mix. Furthermore, the dry ice does not dilute the drink as compared to the use of ice wherein water from the ice mixes with the drink.

These and other objects and advantages will be made apparent when considering the following detailed specification when taken in conjunction with the drawings.

LIST OF REFERENCE NUMERALS USED IN THE DRAWINGS

Figure 1:
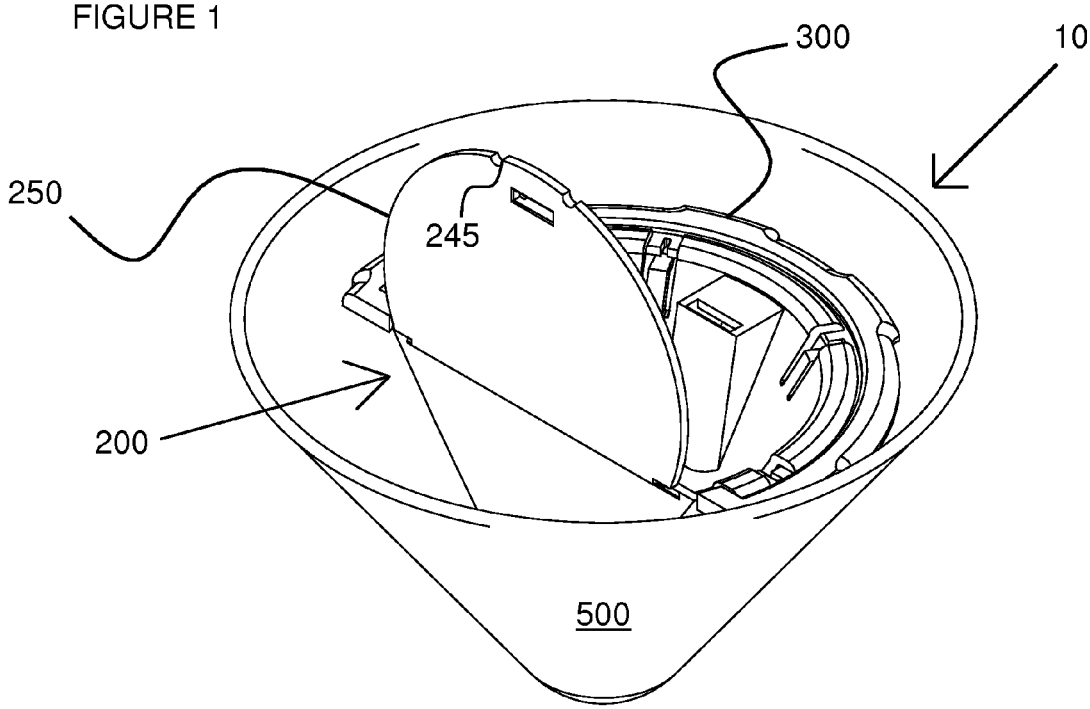
FIG. 1 is a perspective view of invention with the lid in an open position.

10 one embodiment generally of the invention
50 dry ice, solidified $CO_2$ or other material
200 box assembly
201 side retaining hook
208 lower container portion
209 flat vertical section of box
210 slot or void in box to accept lid cantilever hook 253
211 housing unit for slot 210 in box
220 stop tab or box stop tab
221 side retaining hook recess
240 communication slot
245 pry recess or pry recess void, located at edge of lid 250
250 lid assembly in general
251 top surface of lid.
252 bottom surface of lid
253 lid cantilever hook
254 living hinge attaching lid assembly to box assembly.
255 inner side of box assembly
300 clip assembly in general
302 stop tab for shelf or stop tab shelf, suitable for fitting between a side retaining hook 201 and a box stop tab 220
304 void or recess for side retaining hook release
305 optional bar in clip assembly
306 bottom side of clip assembly
307 optional back tab
310 adhesive wedge
311 outer clip spacers
500 drinking vessel
510 area for garnish

DETAILED DESCRIPTION OF THE INVENTION

In the following description, for purposes of explanation, numerous specific details are set forth in order to provide a thorough understanding of the invention. It will be apparent, however, to one skilled in the art that the invention can be practiced without these specific details.

The reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment nor are separate alternative embodiments mutually exclusive of other embodiments.

In the following detailed description of embodiments of the invention, reference is made to the accompanying drawings in which like references indicate similar elements, and in which is shown by way of illustration specific embodiments in which the invention may be practiced. These embodiments are described in sufficient detail to enable those skilled in the art to practice the invention, and it is to be understood that other embodiments may be utilized and that logical, mechanical, electrical, functional, and other changes may be made without departing from the scope of the present invention. The following detailed description is, therefore, not to be taken in a limiting sense.

The description, which follows, and the embodiments described therein, are provided by way of illustration of an example, or examples of particular embodiments of the principles of the present invention. These examples are provided for the purposes of explanation, and not of limitation, of those principles of the invention. In the description, which follows, like parts are marked throughout the specification and the drawings with the same respective reference numerals. The drawings are not necessarily to scale and in some instances proportions may have been exaggerated in order to more clearly depict certain features of the invention.

Figure 2:
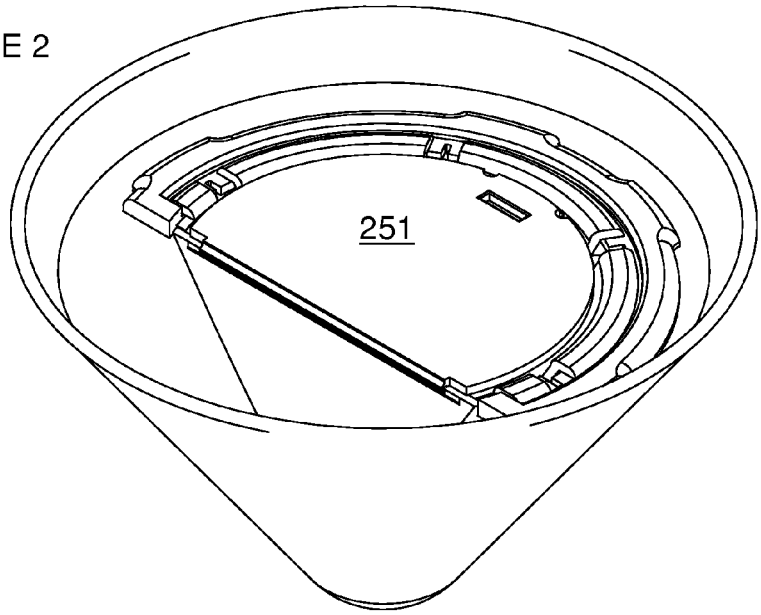
FIG. 2 is a perspective view of the invention with the lid in the closed position.

Referring to FIG. 1, diagram 10 generally illustrates one embodiment of the invention wherein a drinking vessel 500 may contain or secure a clip assembly 300 which in turn may secure a box assembly 200. The lid 250 of the box assembly 200 is shown in the open position. A pry recess 245 is shown on an edge of the lid 250. The pry recess 245 may be used to release the lid when the lid is in the closed position. FIG. 2 shows an embodiment of the invention with the lid in a closed position, exposing the top surface of the lid 251.

Figure 3:
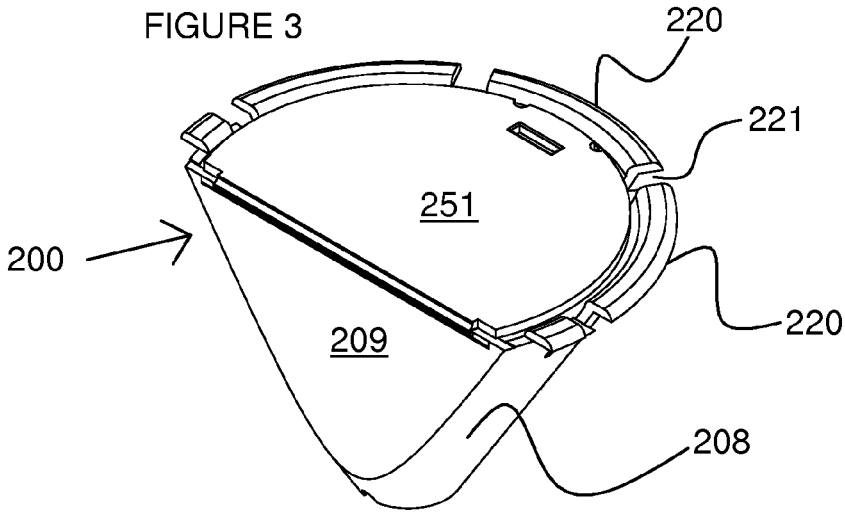
FIG. 3 is a perspective view a lid closed position without the drinking glass or clip assembly.
Figure 5:
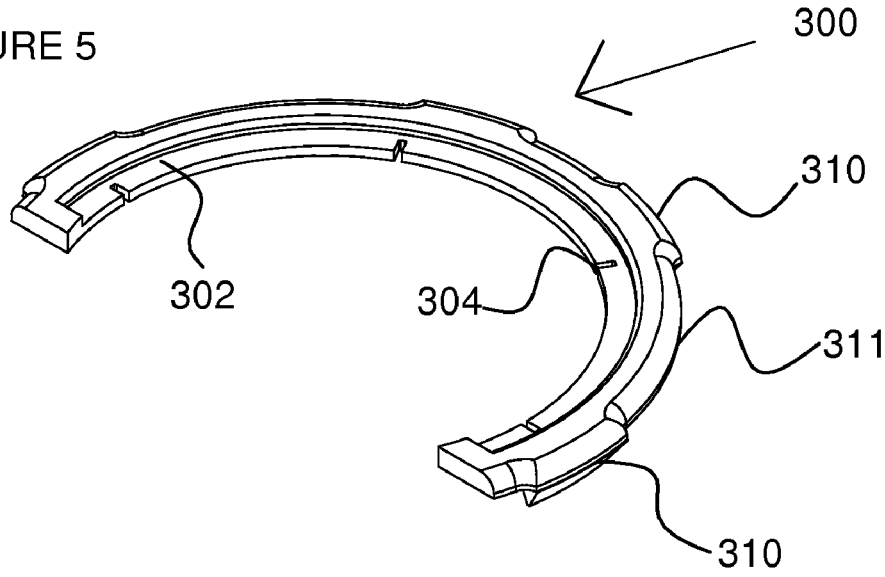
FIG. 5 is an isometric view of the clip assembly.

FIG. 3 shows a flat vertical or nearly vertical (due to injection molding requirements this typically can never be vertical because of "draft") section 209 of the box assembly 200. Stop tabs 220 are shown at the outer and upper section of the box assembly. The stop tabs 220 are used to rest on top of clip assembly 300 (FIG. 5). More particularly, the stop tabs 220 rest on the top side of the stop tab for shelf or stop tab shelf 302, shown in FIG. 5.

Figure 4:
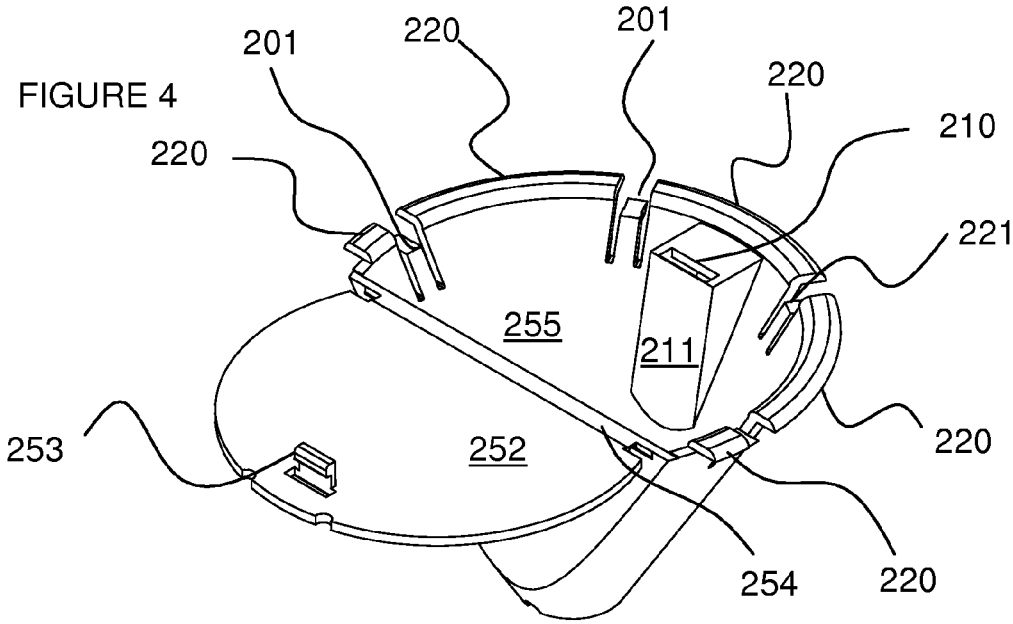
FIG. 4 is a perspective view of the invention in a lid open position without the drinking glass or clip assembly.

FIG. 4 shows an embodiment of the invention with the lid in an open position, exposing the bottom surface 252 of the lid and the lid cantilever hook 253. A living hinge 254 secures the lid to the upper flat vertical section of the box assembly. FIG. 4 shows five sections of stop tabs 220. The inside portions of side retaining hooks 201 are shown and reside within their own side retaining hook recess 221. The space between side retaining hooks 201 and the stop tabs 220 may be used to insert the stop tab for shelf 302 (FIG. 5). By way of further explanation, the side retaining hook recess areas 221 allow the stop tab for shelf 302 (FIG. 5) to fit between the side retaining hooks 201 and bottom surfaces of the stop tabs 220.

In FIG. 4, attached to the inner side 255 of the box assembly a housing unit 211 that contains a slot or void 210. Slot 210 accepts lid cantilever hook 253 to secure the lid in a closed position.

Figure 6:
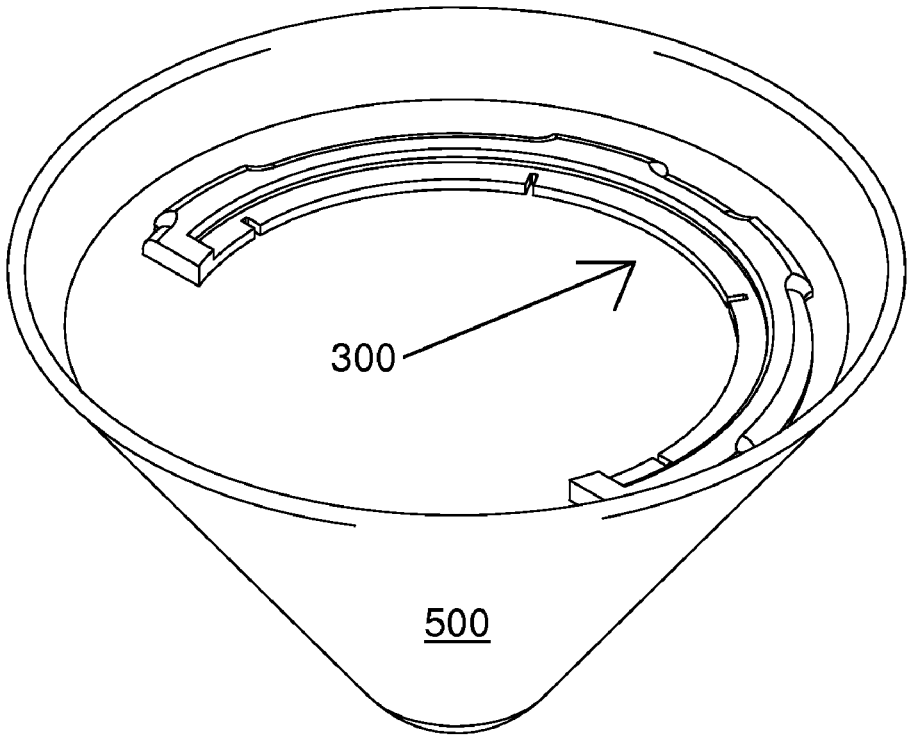
FIG. 6 is perspective view of the clip assembly glued or otherwise attached into a glass or drinking container.
Figure 7:
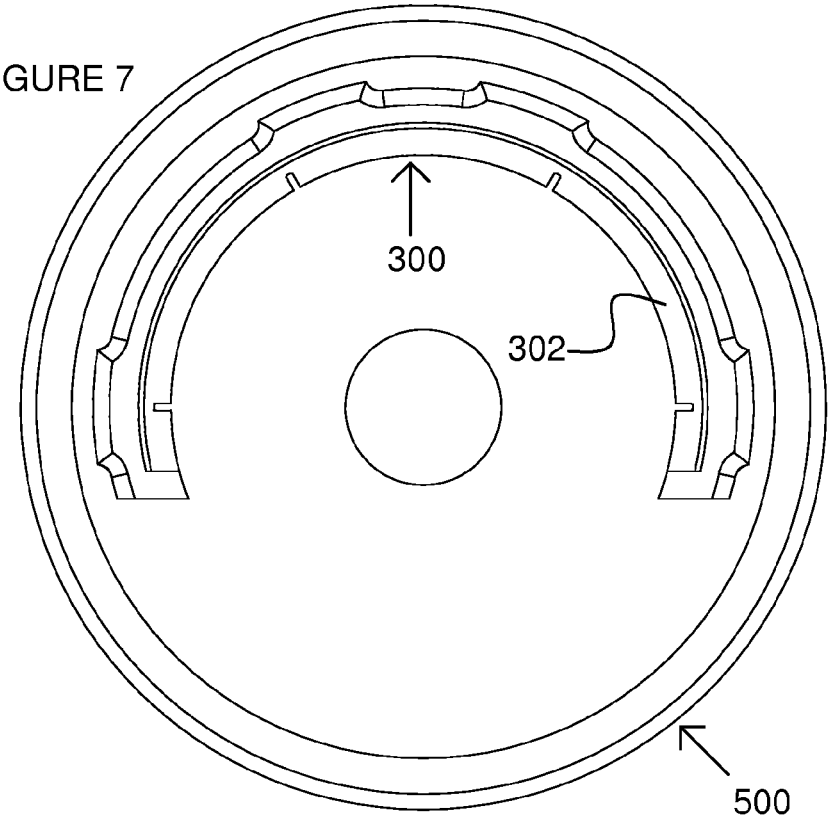
FIG. 7 is a top plan view of the clip assembly glued or otherwise attached into a glass or drinking container.
Figure 19:
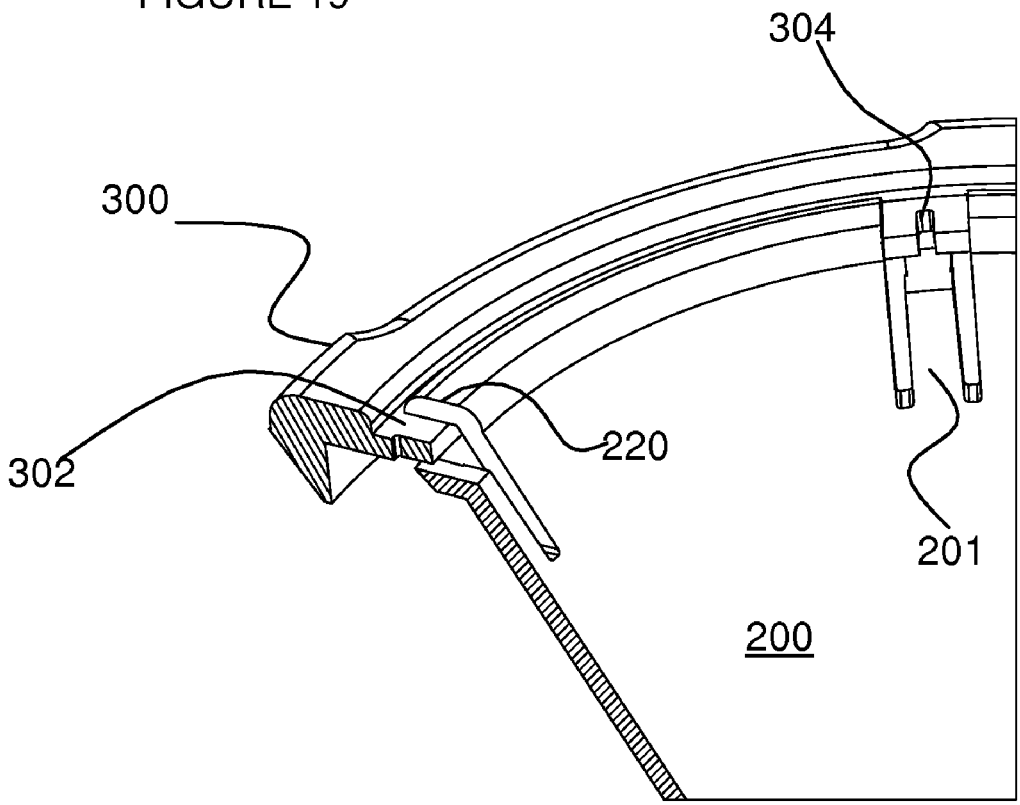
FIG. 19 is an enlarged cross section view of the clip assembly and box assembly showing a side hook of the box engaged with the clip.

FIG. 5 shows a clip assembly 300 in general which may attach into a drinking vessel by securing an adhesive wedge(s) 310 into a drinking vessel. FIG. 5 shows an outer clip recess 311 located between two adhesive wedges 310. The outer clip recess allows for space between the clip assembly and a drinking vessel to allow liquid to flow around the assembly to allow drinking from the glass in any orientation. On the stop tab for shelf 302 are one or more voids or recesses 304 for side retaining hook release. A recess 304 for side retaining hook release may be centered or adjacent to a side retaining hook 201, as shown in FIG. 19. FIG. 6 shows a clip assembly attached to a drinking vessel 500. FIG. 7 is a top plan view of a clip assembly 300 resting within a drinking vessel 500.

Figure 8:
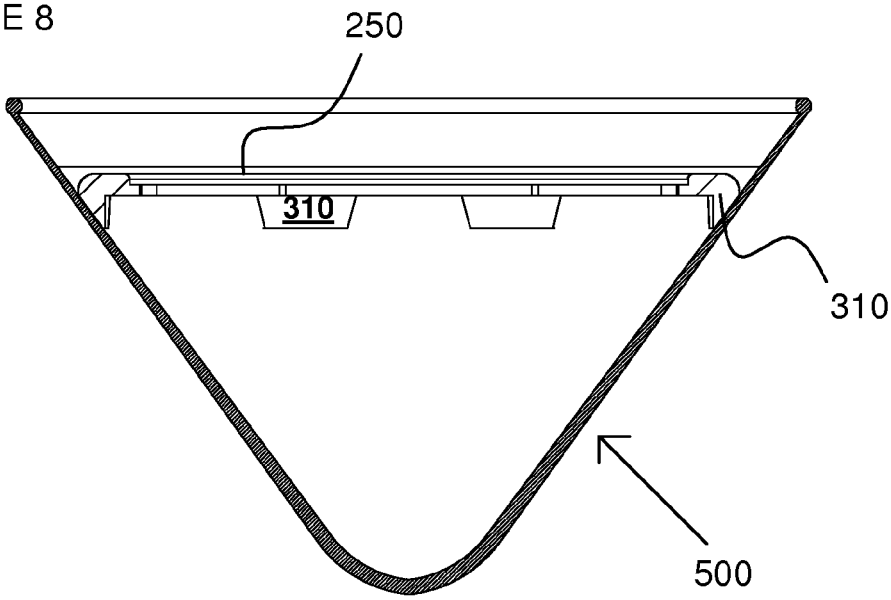
FIG. 8 is a side sectional view of the clip assembly glued or otherwise attached into a glass or drinking container.

FIG. 8 is a cross sectional view of a drinking vessel 500. FIG. 8 shows adhesive wedges 310 secured to the inside portion of drinking vessel 500. Lid 250 is shown in a closed position.

Figure 9:
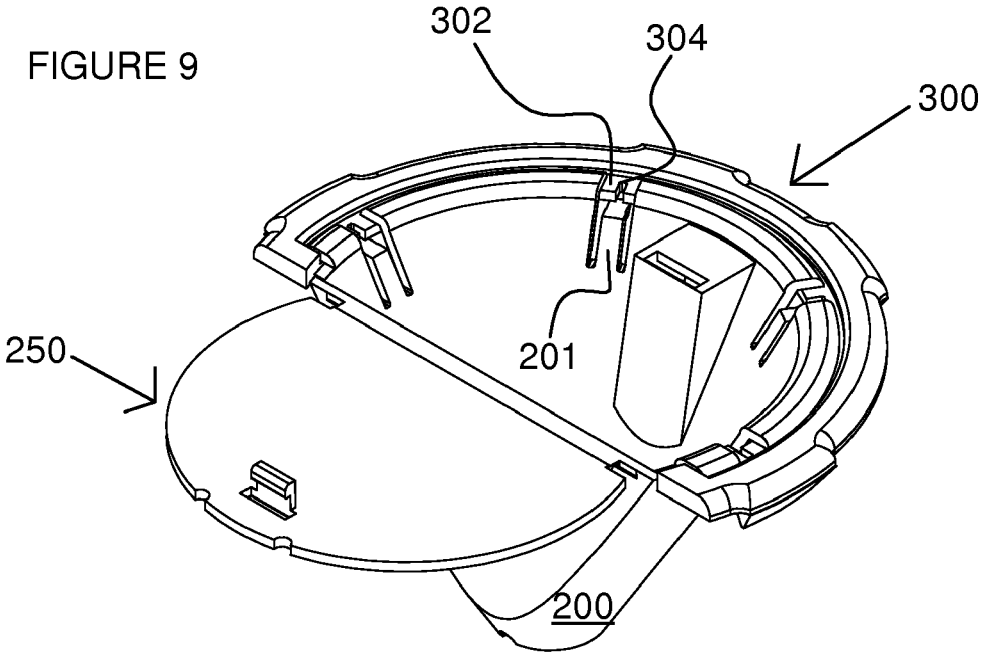
FIG. 9 is a perspective view of the box assembly attached to the clip assembly with the box lid in an open position.

FIG. 9 shows a box assembly 200 attached to a clip assembly 300 while the lid 250 is in an open position. A side retaining hook 201 of the box assembly applies upward pressure to the bottom side of stop tab for shelf 302 of the clip assembly. Within stop tab for shelf 302 a recess 304 for side retaining hook release is centered or adjacent over a side retaining hook 201. The recess 304 for side retaining hook release may be used to release a side retaining hook 201 from a stop tab for shelf 302, the latter of which is part of the clip assembly 300. A pin, paperclip or other object may be inserted into a recess 304 for side retaining hook release in order to bend down a side retaining hook 201 and thus release the clip assembly.

Figure 10:
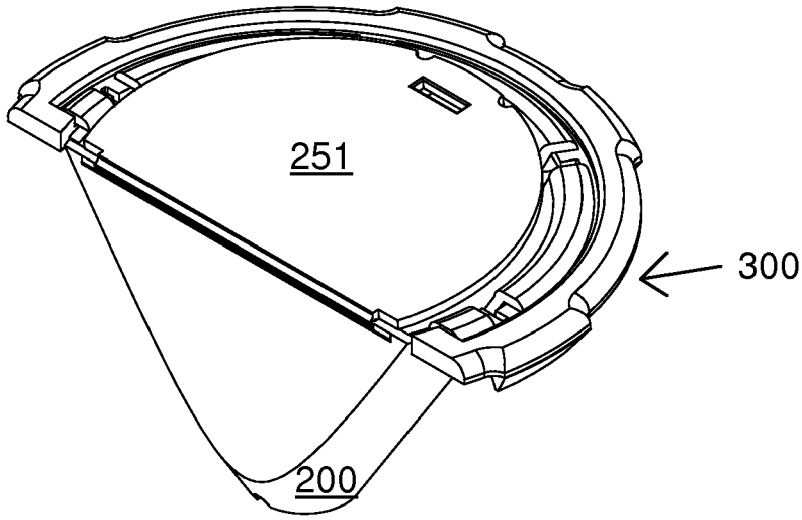
FIG. 10 is a perspective view of the box assembly attached to the clip assembly with the box lid in a closed position.

FIG. 10 shows a box assembly 200 attached to a clip assembly 300 while the lid is in a closed position, exposing the top surface 251 of the lid.

Figure 11:
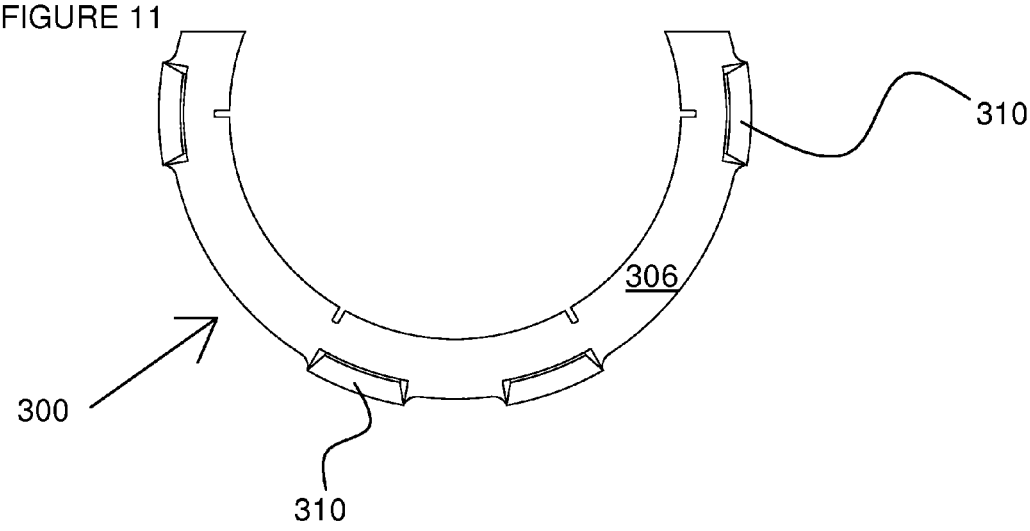
FIG. 11 is a bottom perspective view of the clip assembly.

FIG. 11 is a bottom perspective view of a clip assembly 300 wherein the bottom side 306 of the clip assembly is exposed as well as adhesive wedges 310. The adhesive wedges 310 may be pre-glued or have glue material preinstalled such that a consumer may peel off a protective strip and then secure the adhesive wedges to the inside of a drinking container. The adhesive wedges may also be melted into a drinking container or molded as part of the original construction of a drinking container.

Figure 12:
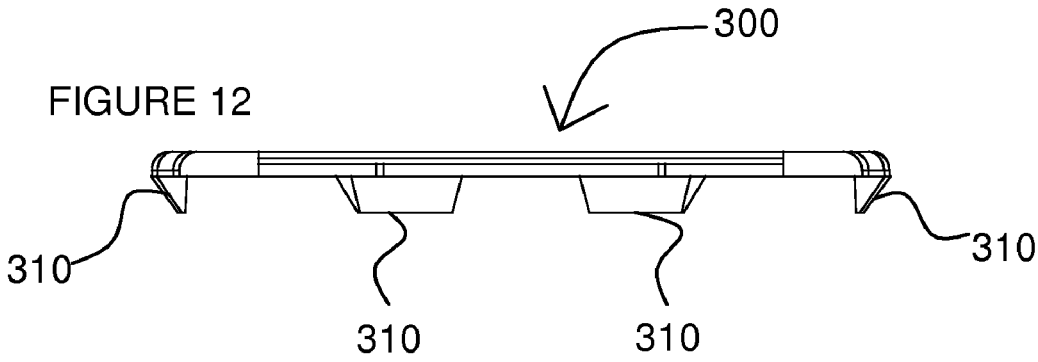
FIG. 12 is an elevational view of the clip assembly.

FIG. 12 is an elevational view of the clip assembly showing adhesive wedges 310 at the outer perimeter of the clip assembly.

Figure 13:
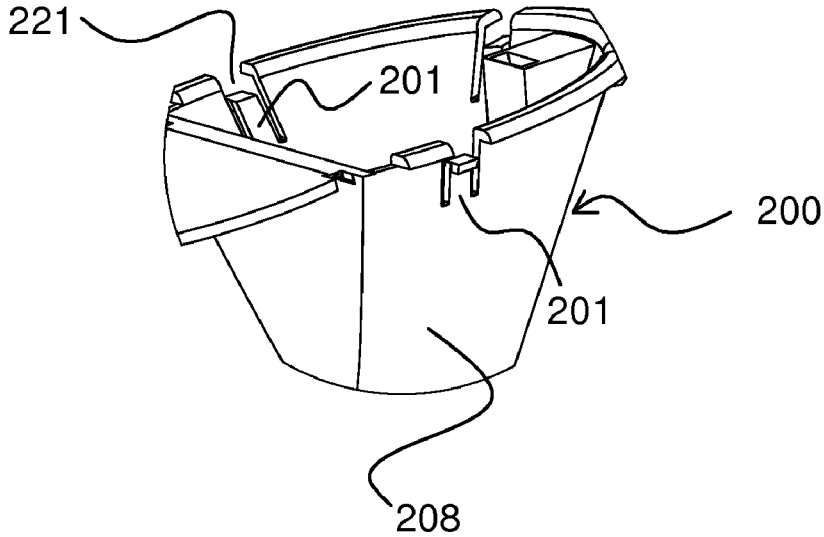
FIG. 13 is an enlarged view of the box showing the side hook and wedge shape head of side hook.

FIG. 13 is a perspective view of portions of the box assembly 200 and shows side retaining hooks 201 and an example of a side retaining hook recess 221 located just above a side retaining hook.

Figure 14:
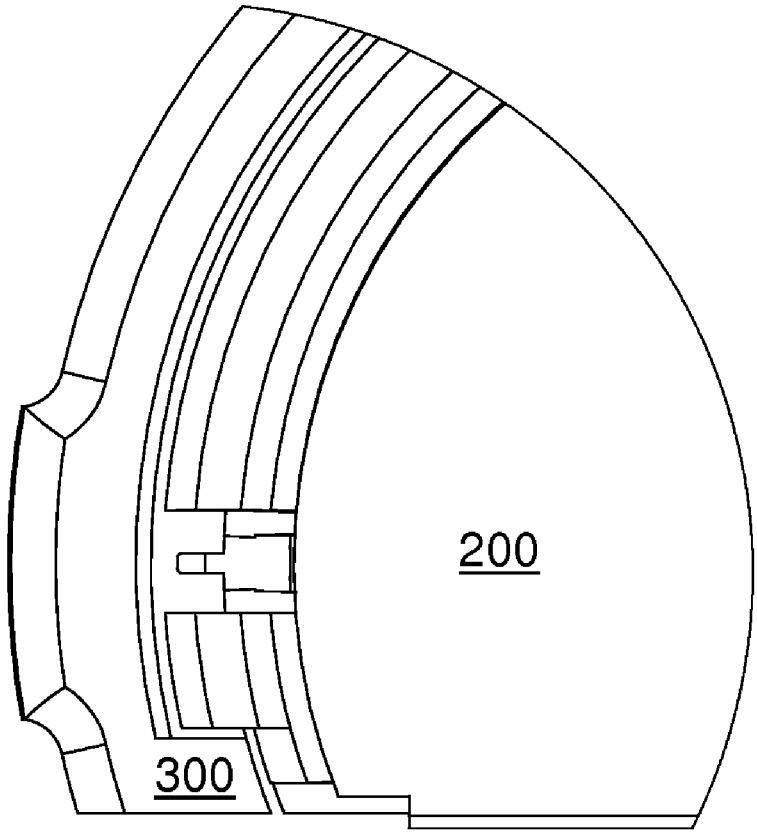
FIG. 14 is an enlarged top view of the box assembly locked into the clip assembly.

FIG. 14 is an enlarged top view of a box assembly 200 locked into a clip assembly 300.

Figure 15:
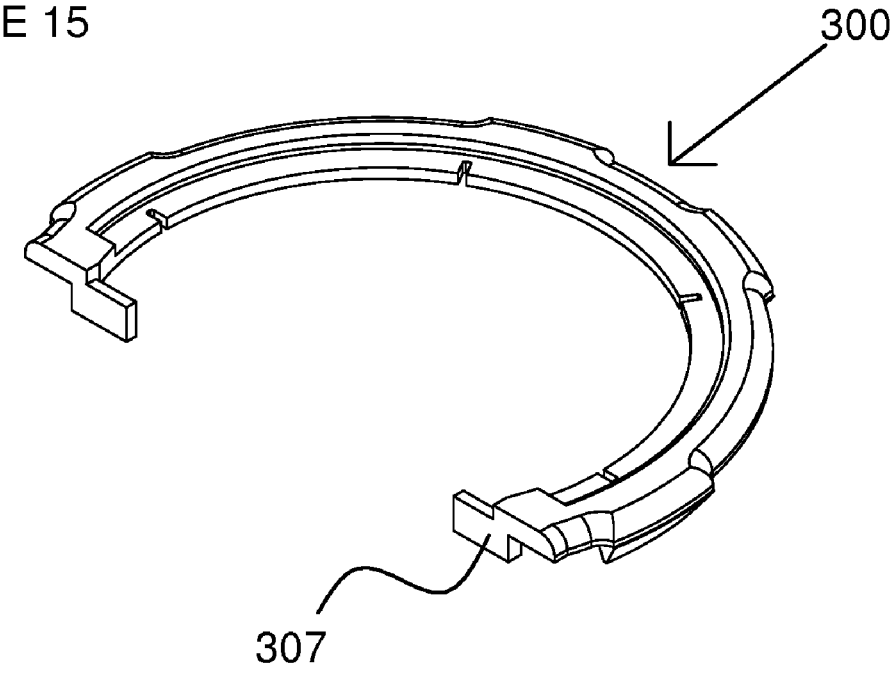
FIG. 15 is an alternative embodiment of the clip assembly shown with an optional back tab
Figure 16:
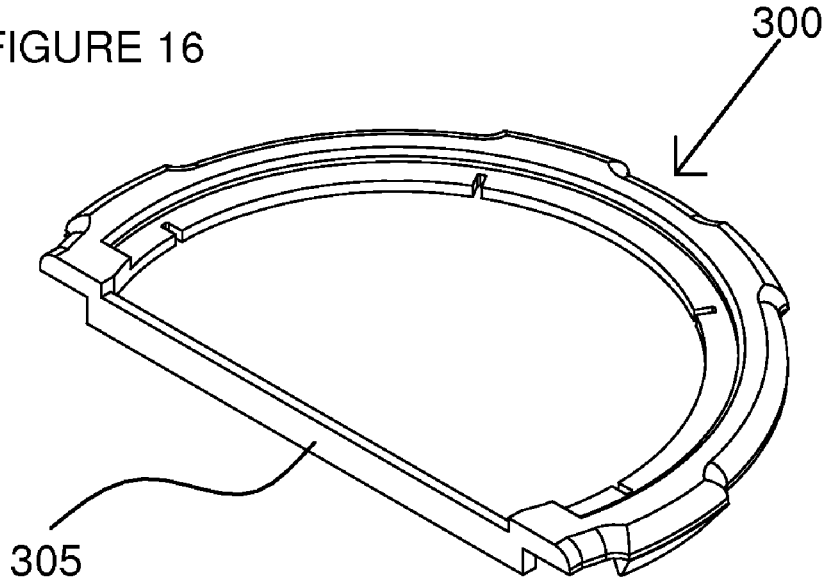
FIG. 16 is an alternative embodiment of the clip assembly shown with an optional bar.

FIG. 15 is an alternative embodiment of a clip assembly 300 shown with an optional back tab 307. The optional back tab 307 may be used to prevent the clip assembly from rotating. FIG. 16 is an alternative embodiment of a clip assembly shown with an optional bar 305.

Figure 17:
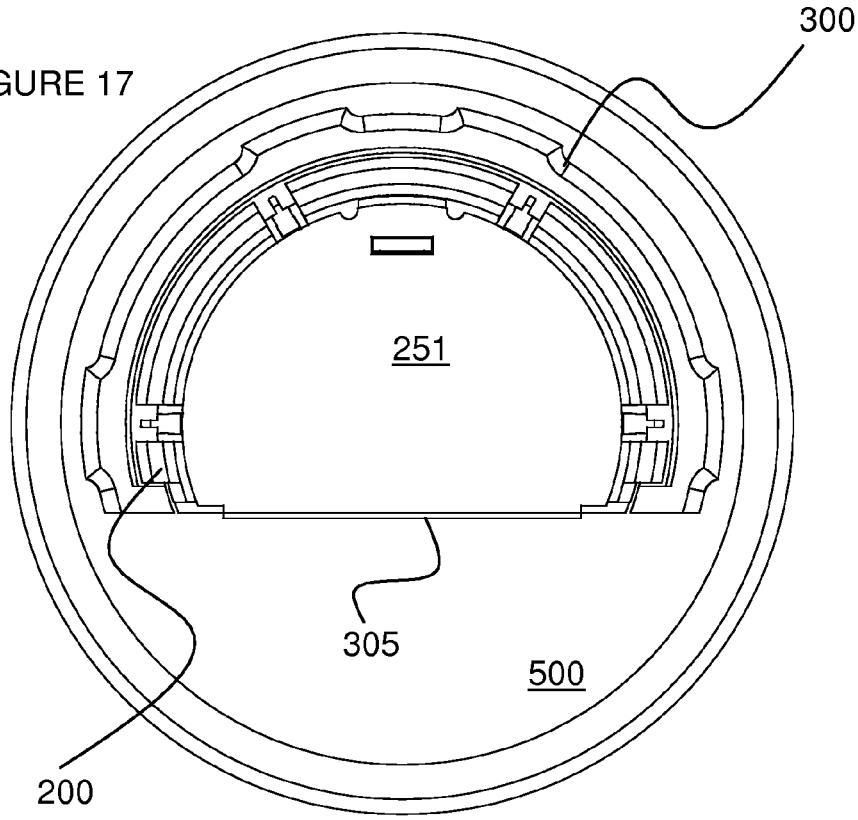
FIG. 17 is a top plan view of the box assembly attached to the clip assembly and the vessel attached to the clip assembly.

FIG. 17 is a top plan view of a box assembly 200 attached to the clip assembly 300 and a drinking vessel 500 attached to the clip assembly. In this embodiment, the optional bar 305 can be seen in the clip assembly as well as the top surface 251 of the lid.

Figure 18:
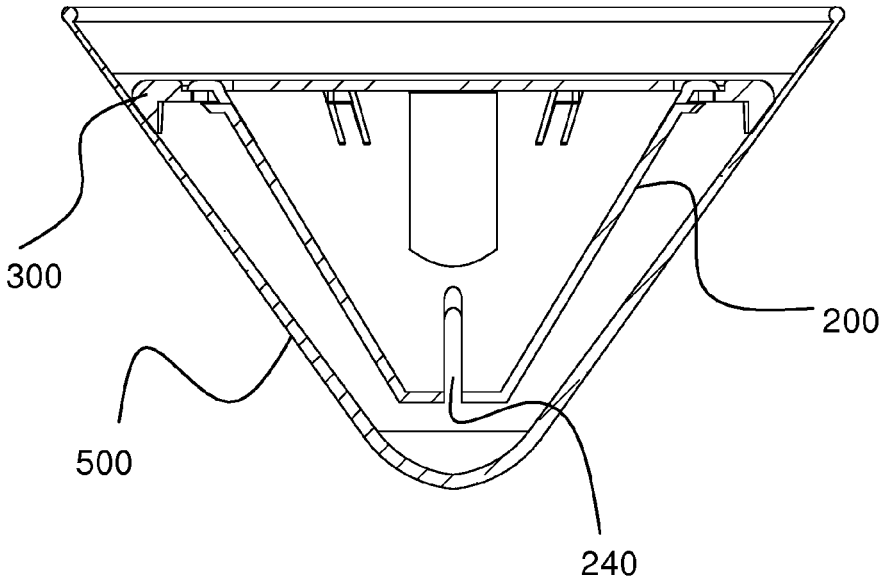
FIG. 18 is a cross sectional view of one embodiment of the invention.

FIG. 18 is a cross sectional view of one embodiment of the invention displaying a communication void 240 located within lower portion of a box assembly 200. The communication void 240 allows the contents of the box assembly to mix or interact with the contents of the drinking vessel 500, but yet not fall into the contents of the drinking vessel. The unobvious combination of a lower communication void within a otherwise solid dry ice container box provides unexpectedly good results in prolonging or extending the melting time of dry ice as compared to the related art. The insulation qualities of a nearly enclosed box assembly keep the dry ice cold and keep the drink contents warm, thus extending the time in which the dry ice is infused into the drink, allowing for a greater time period of witches brew emanating from the surface of the drink. The slot configuration of the disclosed invention places the mixing of dry ice with the drink at points in the bottom of the drink, and thus adds emphasis the effect of fog rising from the bottom of the drink to the surface of the drink. (See above for explanation of the insulating effect).

FIG. 19 is an enlarged cross section view of a clip assembly 300 and box assembly 200 showing a side hook 201 of the box assembly engaged with the lower side of the stop tab shelf 302 of the clip assembly. The upper side of the stop tab shelf 302 rests under the stop tab 220 of the box assembly. Just above each side retaining hook 201 is a matching void or recess 304 within portions of the stop tab shelf 302. Void 304 acts as side retaining hook release. In order to remove the box from the clip, pressure may be applied within recess 304 within the stop tab for shelf 302 in order to release the stop tab for shelf 302 from the grasp of the side retaining hook 201 of the box assembly and stop tab 220 of the box assembly.

Figure 20:
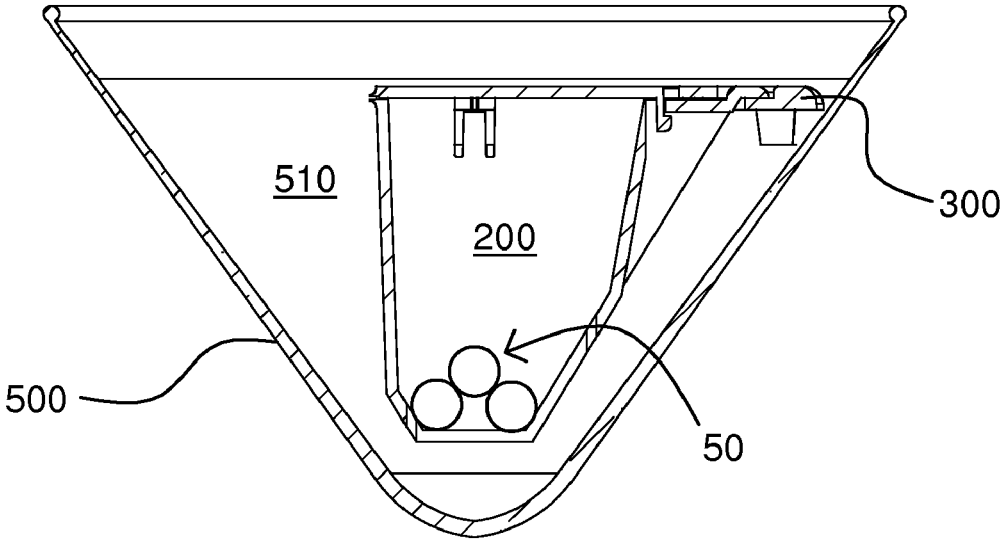
FIG. 20 is a cross sectional view of a drinking glass, clip assembly and box assembly.

FIG. 20 is a cross sectional view of a drinking glass 500, clip assembly and box assembly 200 showing an area 510 for garnish or similar items. Dry ice 50 or other material is shown within the box assembly 200.

Figure 21:
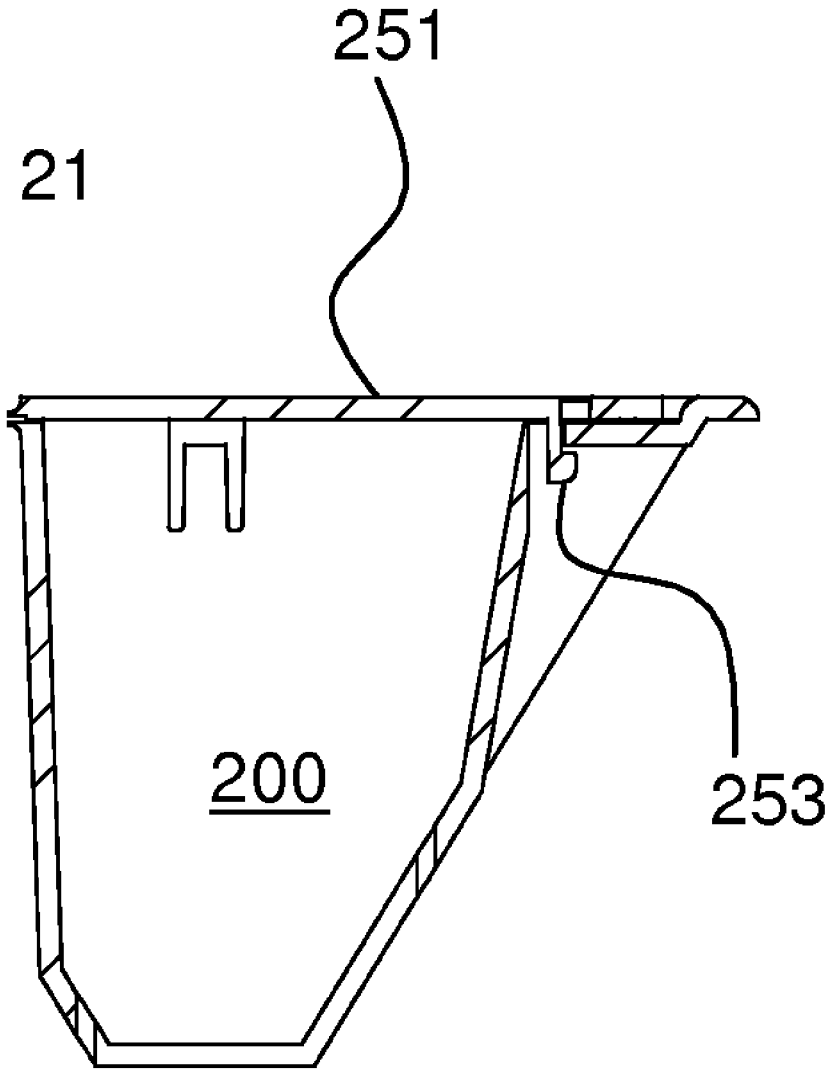
FIG. 21 is a side, cross sectional view of a box assembly with a closed lid.
Figure 22:
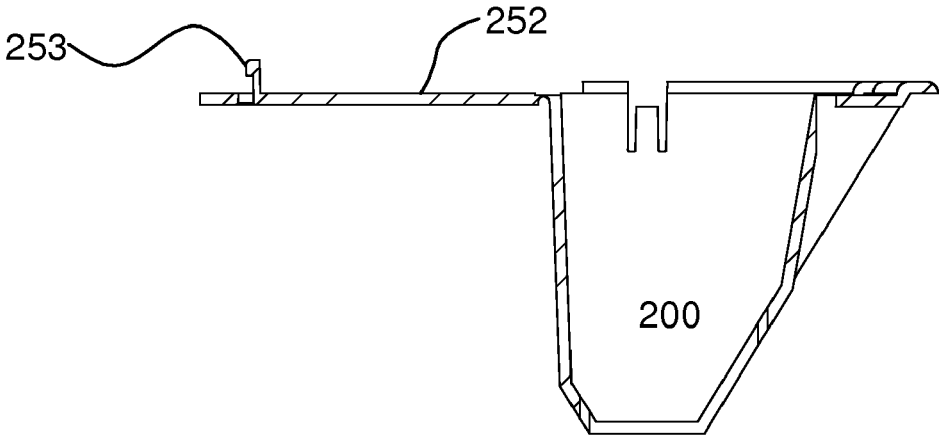
FIG. 22 is a side, cross sectional view of a box assembly with the lid in an open position.
Figure 23:
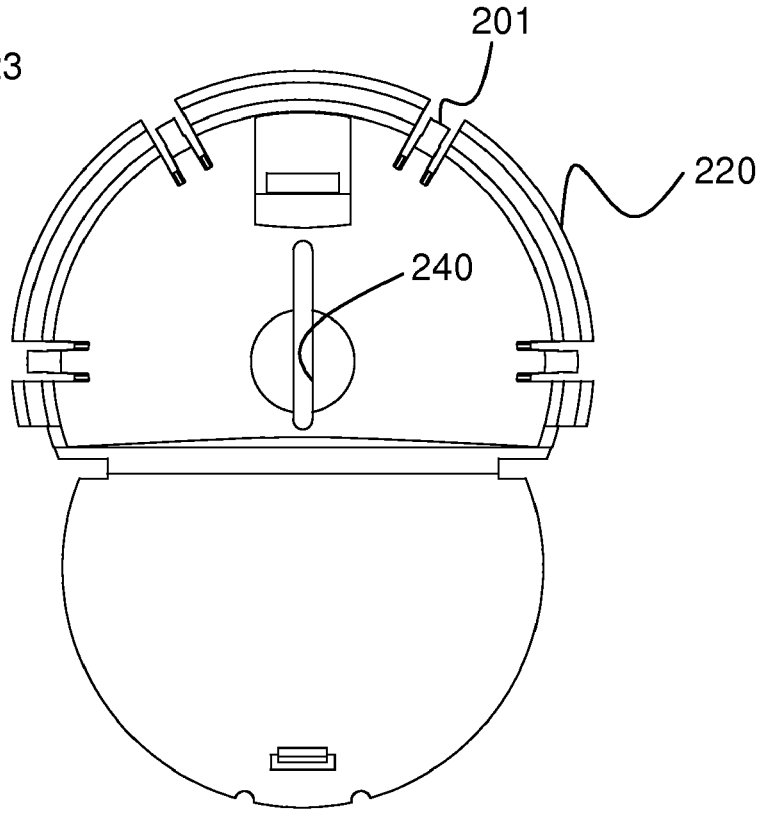
FIG. 23 is a top view of a box assembly with the lid in an open position.

FIG. 21 is a side, cross sectional view of a box assembly 200 with a closed lid, resulting in the top surface 251 of the lid facing away from the box. Lid cantilever hook 253 is shown in a locked position. FIG. 22 is a side cross sectional view of a box assembly 200 with the lid in an open position, exposing the bottom surface 252 of the lid. Lid cantilever hook 253 is shown in an unlocked position. FIG. 23 is a top view of a box assembly with the lid in an open position. A communication slot 240 is visible at the bottom of the box assembly. A stop tab 220 and side hook 201 are also marked.

Other aspects of the invention include, but are not limited to:

Part 1 A system for creating a witches brew effect, the system comprising:

a) a clip assembly 300 comprising:
   - i. a stop tab shelf 302 with one or more voids 304 for a side retaining hook release;
   - ii. a plurality of adhesive wedges 310 attached to the stop tab shelf 302;
   - iii. a plurality of outer clip spacers 311 located between the adhesive wedges 310 and attached to the stop tab shelf 302;

b) a box assembly 200 comprising:
   - i. a lower container portion 208 with inside 255 and outside surfaces and with one flat vertical or nearly vertical section 209;
   - ii. a living hinge 254 with one side connected to the lower container portion 208 and another side of the living hinge connected to a lid 250, the lid having a lid cantilever hook 253;
   - iii. a housing unit 211 attached to the inside surface of the lower container portion and a void or slot 210 within the housing unit, the void or slot 210 being suitable to accept the lid cantilever hook 253, so as to secure the lid in a closed position;
   - iv. a plurality of side retaining hooks 201 attached to the lower container portion 208;
   - v. a plurality of box stop tabs 220 attached to the lower container portion 208 and adjacent to the side retaining hooks 201;
   - vi. a communication slot 240 contained within the bottom of the lower container portion 208;

c) wherein the stop tab shelf 302 of the clip assembly 300 has means of fitting between the side retaining hooks 201 and box stop tabs 220 of the box assembly 300.

Part 2 The system of part 1 further comprising a drinking vessel 500 suitable for attachment to the adhesive wedges 310 of the clip assembly 300.

Part 3 The system of part 2 wherein the drinking vessel 500 is attached to the clip assembly 300 by use of the adhesive wedges 310 of the clip assembly.

Part 4 The system part 1 including an adhesive suitable for securing the adhesive wedges 310 to a drinking vessel 500. The adhesive may be applied onto the adhesive wedges and covered with a protective wrapping. The adhesive may also be applied to the drinking vessel.

Part 5 The system of part 2 wherein the clip assembly is molded or contained within the drinking vessel. In this embodiment, the drinking vessel and clip assembly may be manufactured or integrated into one unit.

Part 6 The system of part 1 wherein the lid 250 has one or more pry recess voids 245 with means to allow insertion of a tool to move the lid cantilever hook 253 from the slot 210 of the housing unit 211.

Part 7 A kit for infusing dry ice or other material into a drink, the kit comprising:

a) a clip assembly comprising:
   i. a stop tab shelf with one or more voids;
   ii. a plurality of adhesive wedges attached to the stop tab shelf;
   iii. a plurality of outer clip spacers located between the adhesive wedges and attached to the stop tab shelf;

b) a box assembly comprising:
   i. a lower container portion with inside and outside surfaces and with one flat vertical section;
   ii. a living hinge with one side connected to the lower container portion and another side of the living hinge connected to a lid, the lid having a lid cantilever hook;
   iii. a housing unit attached to the inside surface of the lower container portion and a void within the housing unit, the void being suitable to accept the lid cantilever hook, so as to secure the lid in a closed position;
   iv. a plurality of side retaining hooks attached to the lower container portion;
   v. a plurality of box stop tabs attached to the lower container portion and adjacent to the side retaining hooks; and
   vi. a communication slot contained within the bottom of the bottom of the lower container portion.

Part 8 The kit of part 7 further including a drinking glass suitable for attachment to the adhesive wedges of the clip assembly.

Part 9 The kit of part 8 further including means of attaching the adhesive wedges to the drinking glass.

Part 10 The kit of part 9 wherein the means of attaching the adhesive wedges to the drinking glass include an adhesive suitable for attaching the adhesive wedges to the drinking glass.

Part 11 The kit of part 10 wherein the clip assembly is molded or fabricated within the drinking glass.

Part 12 A method of trapping and infusing dry ice or other material within the contents of a drinking glass, the method comprising:

a) using a clip assembly which uses
   i. a stop tab shelf with one or more voids;
   ii. a plurality of adhesive wedges attached to the stop tab shelf;
   iii. a plurality of outer clip spacers located between the adhesive wedges and attached to the stop tab shelf;

b) using a box assembly which uses:
   i. a lower container portion with inside and outside surfaces and with one flat vertical or nearly section;
   ii. a living hinge with one side connected to the lower container portion and another side of the living hinge connected to a lid, the lid having a lid cantilever hook;
   iii. a housing unit attached to the inside surface of the lower container portion and a void within the housing unit, the void being suitable to accept the lid cantilever hook, so as to secure the lid in a closed position;
   iv. a plurality of side retaining hooks attached to the lower container portion;
   v. a plurality of box stop tabs attached to the lower container portion and adjacent to the side retaining hooks; and
   vi. a communication slot contained within the bottom of the bottom of the lower container portion.

Part 13 The method of part 12 further comprising the use of a drinking glass suitable for attachment to the clip assembly.

Part 14 The method of part 13 further comprising the step of attaching the clip assembly to the drinking glass.

Part 15 The method of part 14 further comprising the step of attaching the box assembly to the clip assembly.

Part 16 The method of part 15 further comprising the step of placing dry ice 50 or similar material into the box assembly.

Part 17 The method of part 16 further comprising the step of pouring liquid into the drinking glass.

Part 18 The method of part 12 using the system of part 1.

What is claimed is:

1. A system for creating a witches brew effect, the system comprising:

a) a clip assembly comprising:
   i. a stop tab shelf directly connected to an inside portion of the clip assembly, the stop tab shelf comprising a semi-circle strip, having a top surface, bottom surface and sidewall surface; the stop tab shelf being disposed within a drinking vessel; the stop tab shelf having one or more stop tab shelf voids, with the stop tab shelf voids defined by edges of radial sections of the stop tab shelf;
   ii. a plurality of adhesive wedges attached to the stop tab shelf;
   iii. a plurality of outer clip spacers located between the adhesive wedges and attached to the stop tab shelf;

b) a box assembly comprising:
   i. a lower container portion with inside and outside surfaces and with one flat vertical or nearly vertical section;
   ii. a living hinge with one side connected to the lower container portion and another side of the living hinge connected to a lid, the lid having a lid cantilever hook;
   iii. a housing unit attached to the inside surface of the lower container portion and the housing unit having a housing unit void, the housing unit void being defined by a horizontal surface on top of the housing unit; the housing unit void being suitable to accept the lid cantilever hook, so as to secure the lid in a closed position;
   iv. a plurality of side retaining hooks attached to the lower container portion;
   v. a plurality of box stop tabs attached to the lower container portion and directly connected to the side retaining hooks;
   vi. a communication slot defined by the bottom surfaces of the lower container portion;
   vii. wherein the lid has one or more pry recess voids with the pry recess voids defined by a surface of the lid c) wherein the stop tab shelf of the clip assembly has means of fitting between the side retaining hooks and box stop tabs of the box assembly; and d) the clip assembly is disposed within the drinking vessel.

2. A kit for infusing dry ice or other material into a drink, the kit comprising:

a) a clip assembly comprising:

i. a stop tab shelf directly connected to an inside portion of the clip assembly, the stop tab shelf comprising a semi-circle shape, having a top surface, bottom surface and sidewall surface; the stop tab shelf being disposed within a drinking vessel; the stop tab shelf having one or more stop tab shelf voids, with the stop tab shelf voids defined by radial sections of the stop tab shelf ii. a plurality of adhesive wedges attached to the stop tab shelf;

iii. a plurality of outer clip spacers located between the adhesive wedges and attached to the stop tab shelf;

b) a box assembly comprising:

i. a lower container portion with inside and outside surfaces and with one flat vertical or nearly vertical section;

ii. a living hinge with one side connected to the lower container portion and another side of the living hinge connected to a lid, the lid having a lid cantilever hook wherein the lid has one or more pry recess voids the pry recess voids defined by a surface of the lid;

iii. a housing unit attached to the inside surface of the lower container portion and the housing unit having a housing unit void within the housing unit, the housing unit void being defined by a horizontal surface on top of the housing unit; the housing unit void being suitable to accept the lid cantilever hook, so as to secure the lid in a closed position;

iv. a plurality of side retaining hooks attached to the lower container portion;

v. a plurality of box stop tabs attached to the lower container portion and directly connected to the side retaining hooks; and vi. a communication slot defined by the bottom surfaces of the lower container portion.

3. A method of trapping and infusing dry ice or other material within the contents of a drinking glass, the method comprising:

a) using a clip assembly which uses i. a stop tab shelf directly connected to an inside portion of the clip assembly, the stop tab shelf comprising a semi-circle shape, having a top surface, bottom surface and sidewall surface; the stop tab shelf being disposed within a drinking vessel; the stop tab shelf having one or more stop tab shelf voids, with the stop tab shelf voids defined by radial sections of the stop tab shelf;

ii. a plurality of adhesive wedges attached to the stop tab shelf;

iii. a plurality of outer clip spacers located between the adhesive wedges and attached to the stop tab shelf;

b) using a box assembly which uses:

i. a lower container portion with inside and outside surfaces and with one flat vertical or nearly vertical section;

ii. a living hinge with one side connected to the lower container portion and another side of the living hinge connected to a lid, the lid having a lid cantilever hook, wherein the lid has one or more pry recess voids the pry recess voids defined by a surface of the lid iii. a housing unit attached to the inside surface of the lower container portion and the housing unit having a housing unit void, the housing unit void being defined by a horizontal surface on top of the housing unit; the housing unit void being suitable to accept the lid cantilever hook, so as to secure the lid in a closed position;

iv. a plurality of side retaining hooks attached to the lower container portion;

v. a plurality of box stop tabs attached to the lower container portion and directly connected to the side retaining hooks; and vi. a communication slot defined by the bottom surfaces of the lower container portion.

4. The method of claim 3 further comprising a) the use of a drinking glass suitable for attachment to the clip assembly;

b) the step of attaching the box assembly to the clip assembly; and c) the step of placing dry ice or similar material into the box assembly.

5. The method of claim 3 further comprising using the clip assembly and the box assembly wherein the stop tab shelf of the clip assembly has means of fitting between the side retaining hooks and box stop tabs of the box assembly; and the clip assembly is disposed within the drinking vessel.

* * * * *